US010723151B2

(12) United States Patent
Hoshi

(10) Patent No.: US 10,723,151 B2
(45) **Date of Patent: *Jul. 28, 2020**

(54) PRINTER

(71) Applicant: SATO HOLDINGS KABUSHIKI KAISHA, Tokyo (JP)

(72) Inventor: Kazuyuki Hoshi, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/759,383

(22) PCT Filed: Aug. 28, 2017

(86) PCT No.: PCT/JP2017/030688
§ 371 (c)(1),
(2) Date: Mar. 12, 2018

(87) PCT Pub. No.: WO2018/051771
PCT Pub. Date: Mar. 22, 2018

(65) Prior Publication Data

US 2019/0126645 A1 May 2, 2019

(30) Foreign Application Priority Data

Sep. 13, 2016 (JP) ..... 2016-178457
Dec. 19, 2016 (JP) ..... 2016-245501

(51) Int. Cl.
*B41J 11/04* (2006.01)
*B41J 2/335* (2006.01)
(Continued)

(52) U.S. Cl.
CPC ..... *B41J 11/04* (2013.01); *B41J 2/32* (2013.01); *B41J 2/33505* (2013.01);
(Continued)

(58) Field of Classification Search
CPC . B41J 2/32; B41J 2/335; B41J 2/33505; B41J 3/4075; B41J 11/04; B41J 13/10;
(Continued)

(56) References Cited

U.S. PATENT DOCUMENTS 5,366,302 A 11/1994 Masumura et al.
5,565,905 A 10/1996 Kajiya et al.
(Continued)

FOREIGN PATENT DOCUMENTS

EP 0 765 761 A1 4/1997
EP 2 641 745 A1 9/2013
(Continued)

OTHER PUBLICATIONS

U.S. Appl. No. 15/759,061, filed Mar. 9, 2018, Kazuyuki Hoshi et al.
U.S. Appl. No. 15/759,331, filed Mar. 12, 2018, Kazuyuki Hoshi et al.
U.S. Appl. No. 15/759,337, filed Mar. 12, 2018, Kazuyuki Hoshi et al.
(Continued)

*Primary Examiner* — Anh T Vo
(74) *Attorney, Agent, or Firm* — Foley & Lardner LLP

(57) ABSTRACT

A printer includes a housing, a printer cover configured to rotate between a closed position at which the printer cover closes an interior of the housing and an open position at which the printer cover opens the interior of the housing, a platen roller configured to feed print medium, a thermal head opposed to the platen roller when the printer cover is located at the closed position, and an operation member configured to connect and disconnect the thermal head, the operation member guides the print medium fed by the platen roller when the printer cover is located at the closed position.

21 Claims, 13 Drawing Sheets

(51) Int. Cl.

| | |
|---|---|
| ***B41J 25/34*** | (2006.01) |
| ***B41J 29/13*** | (2006.01) |
| ***B41J 2/32*** | (2006.01) |
| ***B41J 3/407*** | (2006.01) |

(52) U.S. Cl.
CPC ..... *B41J 3/4075* (2013.01); *B41J 25/34* (2013.01); *B41J 29/13* (2013.01); *B41J 2202/31* (2013.01)

(58) Field of Classification Search
CPC . B41J 15/042; B41J 25/34; B41J 29/02; B41J 29/13
See application file for complete search history.

(56) References Cited

U.S. PATENT DOCUMENTS

| | | | | |
|---|---|---|---|---|
| D375,975 | S | 11/1996 | Koizumi et al. | |
| 5,779,371 | A | 7/1998 | Aoyama et al. | |
| D410,949 | S | 6/1999 | Fowkes | |
| D542,344 | S | 5/2007 | Duby et al. | |
| 7,399,130 | B2 | 7/2008 | Hirte et al. | |
| 8,068,127 | B2 * | 11/2011 | Ochiai | B41J 3/4075 347/177 |
| D652,446 | S | 1/2012 | Brady et al. | |
| D653,284 | S | 1/2012 | Amidon et al. | |
| 8,564,633 | B2 | 10/2013 | Matsushima et al. | |
| 8,610,752 | B2 | 12/2013 | Tsugaru | |
| 10,442,222 | B2 * | 10/2019 | Hoshi | B41J 29/13 |
| 10,479,107 | B2 * | 11/2019 | Hoshi | B41J 2/325 |
| 2001/0005216 | A1 * | 6/2001 | Takahashi | B41J 2/32 347/215 |
| 2002/0048479 | A1 | 4/2002 | Bryant et al. | |
| 2003/0146968 | A1 | 8/2003 | Milton | |
| 2011/0193926 | A1 | 8/2011 | Matsushima et al. | |
| 2011/0193927 | A1 * | 8/2011 | Matsushima | B41J 2/32 347/218 |
| 2012/0212562 | A1 | 8/2012 | Tsugaru | |
| 2016/0347093 | A1 | 12/2016 | Ogasawara et al. | |
| 2019/0039393 | A1 * | 2/2019 | Hoshi | B41J 29/02 |
| 2019/0299679 | A1 | 10/2019 | Ushiama | |

FOREIGN PATENT DOCUMENTS

| | | | |
|---|---|---|---|
| JP | 57-088131 | U | 5/1982 |
| JP | 07-081179 | A | 3/1995 |
| JP | 07-256977 | A | 10/1995 |
| JP | 2989024 | B2 | 12/1999 |
| JP | 2003-220722 | A | 8/2003 |
| JP | 2006-334952 | A | 12/2006 |
| JP | 2006-334953 | A | 12/2006 |
| JP | 2007-136931 | A | 6/2007 |
| JP | 2006-334952 | A | 12/2008 |
| JP | 2012-171114 | A | 9/2012 |
| JP | 2014-133364 | A | 7/2014 |
| WO | WO-2018/051767 | A1 | 3/2018 |
| WO | WO-2018/051769 | A1 | 3/2018 |
| WO | WO-2018/051770 | A1 | 3/2018 |

OTHER PUBLICATIONS

U.S. Appl. No. 15/907,890, filed Feb. 28, 2018, Kazuyuki Hoshi et al.
U.S. Appl. No. 15/638,654, filed Feb. 28, 2018, Kazuyuki Hoshi et al.
U.S. Appl. No. 29/659,475, filed Aug. 9, 2018, Yasuhide et al.
Google translation of JP 2007-136931, published on Jun. 2007, 5 pages.
Machine-generated translation of JP 2006-334952, published on Dec. 2006, 17 pages.
USPTO Notice of Allowance, U.S. Appl. No. 15/759,061, dated Jan. 24, 2019, 15 pages.
USPTO Notice of Allowance, U.S. Appl. No. 15/759,331 dated Jan. 31, 2019, 13 pages.
USPTO Notice of Allowance, U.S. Appl. No. 15/759,331, dated May 8, 2019, 21 pages.
USPTO Office Action, U.S. Appl. No. 15/759,061, dated May 7, 2019, 14 pages.
Human English Translation of JP 2006-334952, 39 pages.
USPTO Office Action, U.S. Appl. No. 15/759,337, dated Apr. 10, 2019, 11 pages.
U.S. Appl. No. 29/638,654, filed Feb. 28, 2018, Kazuyuki Hoshi et al.
European Search Report, Application No. 17850671.3, dated Jul. 30, 2019, 11 pages.
European Search Report, Application No. 17850673.9, dated Jul. 9, 2019, 8 pages.
European Search Report, Application No. 17850674.7, dated Jul. 30, 2019, 8 pages.
European Search Report, Application No. 17850675.4, dated Jul. 16, 2019, 9 pages.
USPTO Notice of Allowance, U.S. Appl. No. 15/759,337, dated Jul. 15, 2019, 9 pages.
USPTO Office Action, U.S. Appl. No. 15/907,890, dated Aug. 7, 2019, 16 pages.
European Office Action, Application No. 17 850 671.3, dated Mar. 18, 2020, 6 pages.
European Office Action, Application No. 17 850 674.7, dated Mar. 18, 2020, 5 pages.
Chinese Office Action, Application No. 201780045890.X, dated Jan. 2, 2020, 7 pages.
Chinese Office Action, Application No. 201780045900.X, dated Jan. 2, 2020, 7 pages.
Chinese Office Action, Application No. 201780045904.8, dated Dec. 26, 2019, 6 pages.
Google translation of JP 2006-334953, published on Dec. 2006. (Year: 2006).
Notice of Allowance, U.S. Appl. No. 15/759,061, dated Jan. 15, 2020, 12 pages.
U.S. Appl. No. 16/607,427, filed Oct. 23, 2019, Sato Holdings Kabushiki Kaisha.
USPTO Notice of Allowance, U.S. Appl. No. 15/759,061, dated Nov. 13, 2019, 13 pages.
USPTO Restriction Office Action, U.S. Appl. No. 29/659,475, dated Feb. 20, 2020, 14 pages.
Chinese Office Action and English translation, Application No. 201780055650.8, dated Mar. 3, 2020, 13 pages.

* cited by examiner

PRINTER

BACKGROUND OF THE INVENTION

The present invention relates to a printer.

For a printer for printing on a print medium, it is required to stably feed the print medium. Conventionally, a printer that includes a guide roller for guiding the print medium is known (see Patent Document 1: Laid open patent publication JP 2012-171114 A)).

The printer disclosed the Patent Document 1 includes such guide roller. The guide roller contacts a top surface of the print medium to guide the print medium. Thereby, feeding the print medium is stable.

SUMMARY OF THE INVENTION

The guide roller needs a rotation mechanism. Thus, introducing the guide roller increase the production cost of the printer.

When the guide roller contacts the print medium, the guide roller is worn down. That is, the guide roller is supplies. Thus, the guide roller increases the maintenance cost of the printer.

As described above, introducing the guide roller for stably feeding the print medium increases the total cost of the printer.

The present subject matter aims to suppress the total cost of the printer while stably feeding the print medium.

According to one of an aspect of the present invention, a printer, comprising:

a housing;

a printer cover configured to rotate between a closed position at which the printer cover closes an interior of the housing and an open position at which the printer cover opens the interior of the housing;

a platen roller configured to feed print medium;

a thermal head opposed to the platen roller when the printer cover is located at the closed position;

an operation member configured to connect and disconnect the thermal head, the operation member guides the print medium fed by the platen roller when the printer cover is located at the closed position.

Advantageous Effect of the Present Invention

According to one aspect of the present invention, the total cost of the printer may be suppressed and feeding the print medium may be stable.

DETAILED DESCRIPTION OF THE INVENTION

Figure 1:
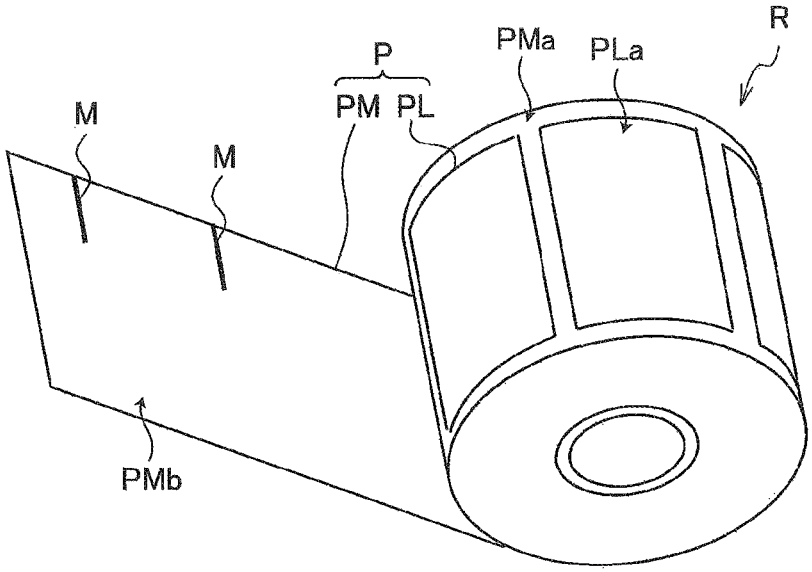
FIG. 1 schematically describes a print medium of the present embodiment.

The following describes the present embodiment.

The following describes one embodiment of the present invention in details, with reference to the drawings. In the drawings describing the embodiment, like numbers indicate like components, and their repeated description is omitted.

In the following description, "FR" refers to the front of a printer and "RR" refers to the rear of the printer.

"UP" refers to the upward when the printer is placed on a horizontal plane, and "LO" refers to the downward when the printer is placed on a horizontal plane.

"LH" and "RH" refer to the direction (hereinafter called a "width direction") orthogonal to the front-rear direction and the up-down direction of the printer.

A part of the printer closer to the container than any referential position on the feed path is refers to the part located "upstream in the feeding direction". A part of the printer closer to the ejection port than the referential position is refers to the part located "downstream in the feeding direction".

(1) PRINT MEDIUM

The following describes a print medium of the present embodiment. FIG. 1 schematically describes a print medium of the present embodiment.

As shown in FIG. 1, a print medium P of the present embodiment includes a liner PM and a plurality of labels PL.

The liner PM includes a temporary-adhesive face PMa and a non temporary-adhesive face PMb on the other side of the temporary-adhesive face PMa.

The plurality of labels PL temporarily adheres to the temporary-adhesive face PMa at predetermined intervals.

On the non temporary-adhesive face PMb, reference marks M are formed at predetermined intervals. A reference mark M shows the reference position for a label PL.

Each label PL has a print surface PLa and a sticking surface PLb (not illustrated).

The print surface PLa includes a thermosensitive layer that develops a color by heat.

On the sticking surface PLb, adhesive is applied.

(2) CONFIGURATION OF PRINTER

Figure 2:
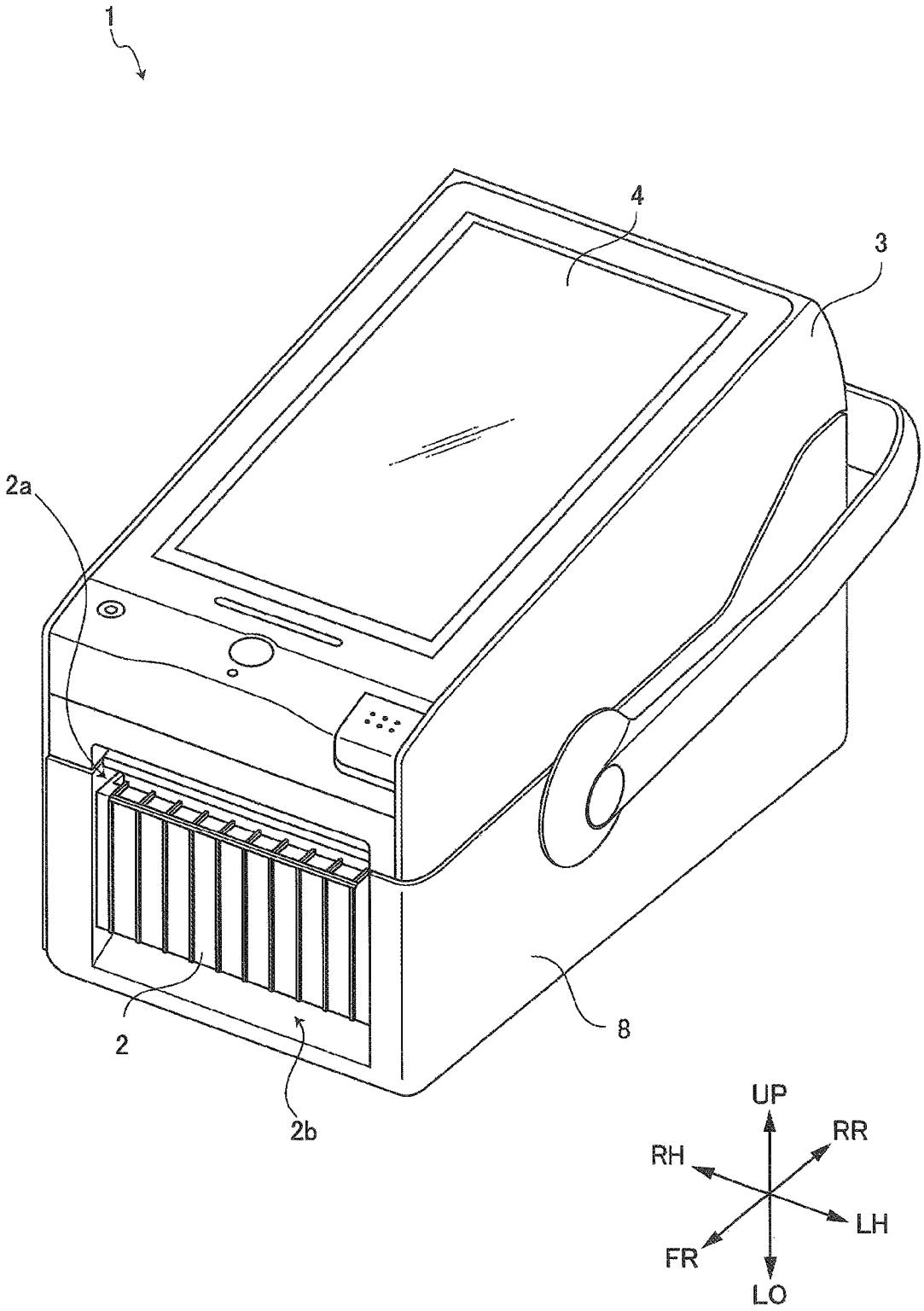
FIG. 2 is a perspective view of a printer of the present embodiment when the printer cover is at a closed position.
Figure 3:
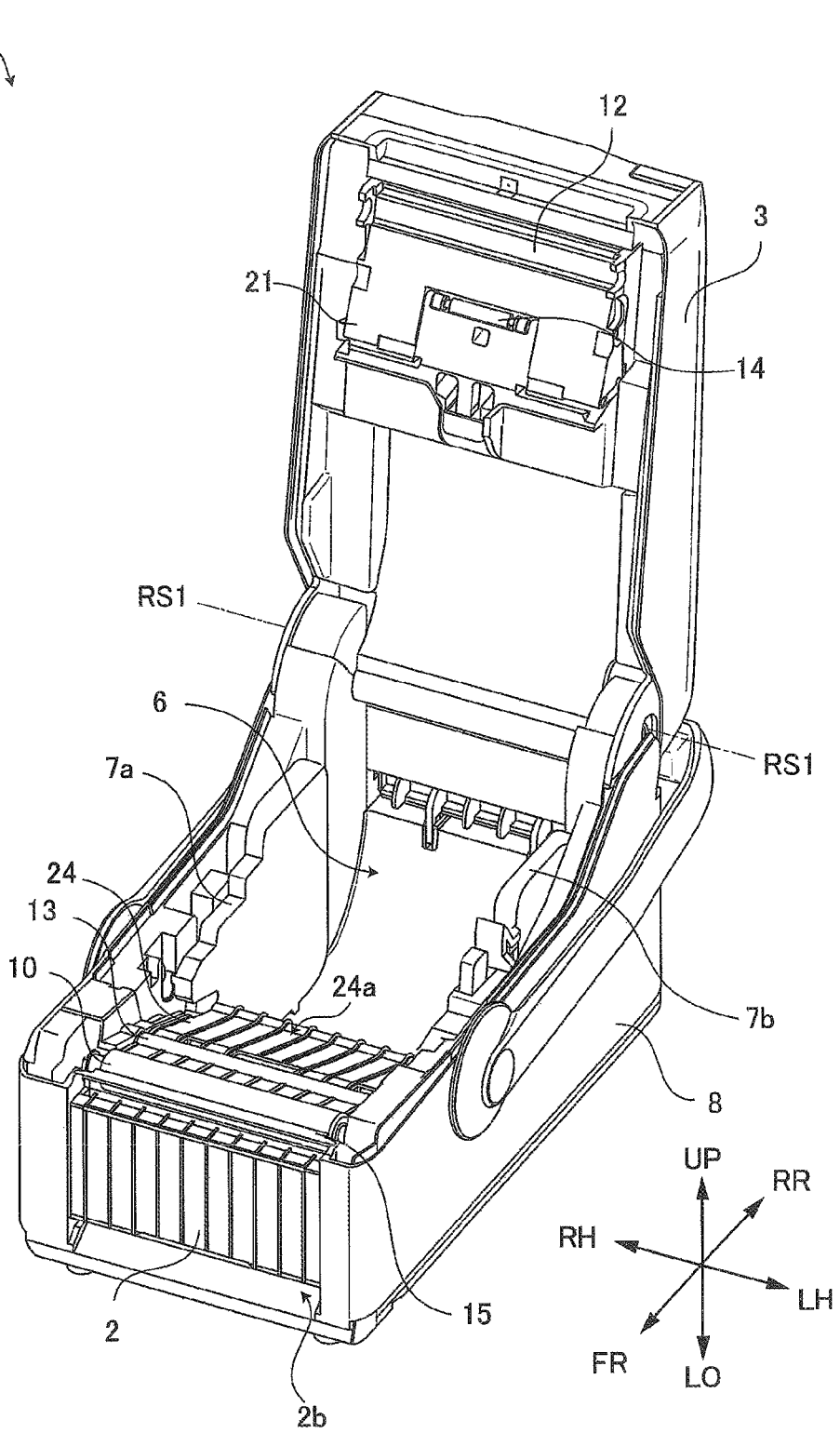
FIG. 3 is a perspective view of the printer of the present embodiment when the printer cover is at an open position and the head cover is at a closed position.
Figure 4:
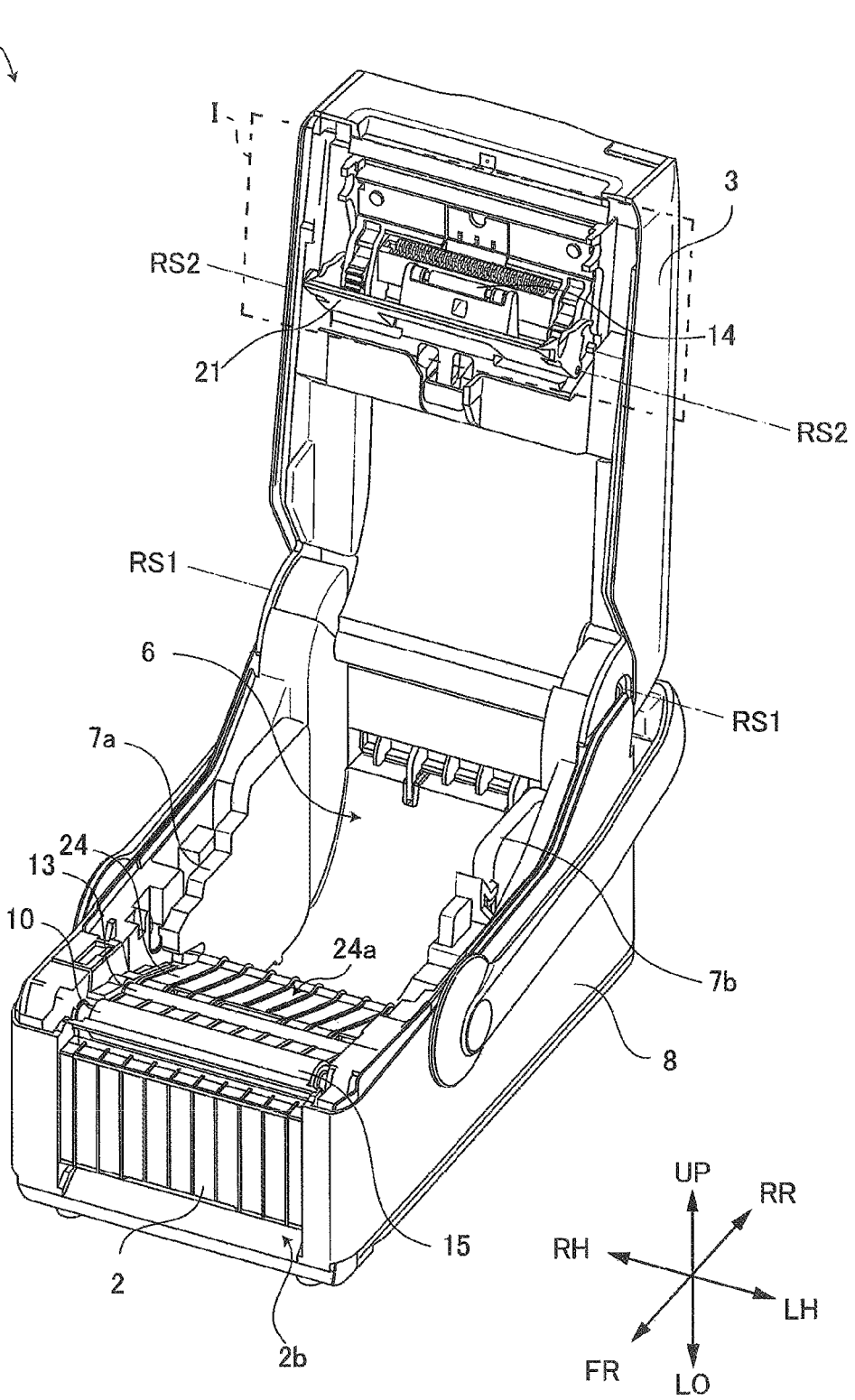
FIG. 4 is a perspective view of the printer of the present embodiment when the printer cover is at an open position and the head cover is at an open position.
Figure 5:
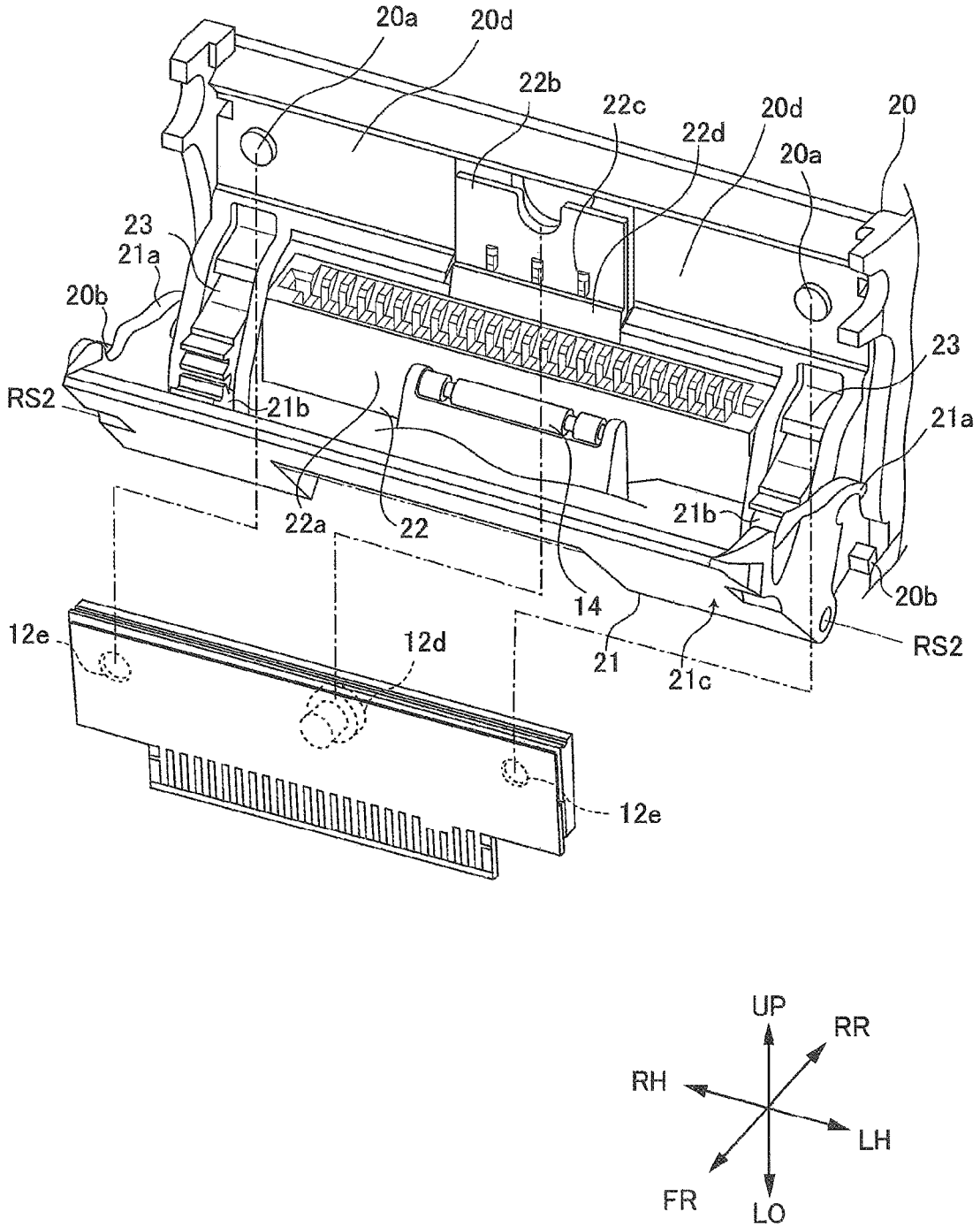
FIG. 5 is an enlarged perspective view of region I of FIG. 4.

The following describes the configuration of a printer of the present embodiment. FIG. 2 is a perspective view of a printer of the present embodiment when the printer cover is at a closed position. FIG. 3 is a perspective view of the printer of the present embodiment when the printer cover is at an open position and the head cover is at a closed position. FIG. 4 is a perspective view of the printer of the present embodiment when the printer cover is at an open position and the head cover is at an open position. FIG. 5 is an enlarged perspective view of region I of FIG. 4. FIG. 6 shows a major part of a connector unit of FIG. 5. FIG. 7 is a perspective view of a major part of a thermal head of FIG. 5.

As shown in FIGS. 2 to 4, the printer 1 includes a front panel 2, a housing 8, a printer cover 3, a touch panel display 4, a container 6, a pair of paper guides 7*a* and 7*b*, a platen roller 10, a thermal head 12, a first assisting roller 13, a second assisting roller 14, a separator 15, a head cover 21 (one example of an operation member), and a feeding guide 24.

A rear end of the printer cover 3 is pivotally supported at a rear end of the housing 8. The printer cover 3 can move (can rotate) relative to the housing 8 between the closed position (FIG. 2) and the open position (FIG. 3) about the rotary axis RS1.

At the closed position, the printer cover 3 closes the housing 8 (for example, the interior of the housing 8 cannot be seen from the outside of the printer 1).

At the open position, the printer cover 3 opens the housing 8 (for example, the interior of the housing 8 can be seen from the outside of the printer 1).

When the printer cover 3 is at the closed position, the platen roller 10 and the thermal head 12 are opposed.

When the printer cover 3 rotates from the closed position to the open position, the front end of the printer cover 3 rotates away from the front end of the front panel 2 and of the housing 8.

When the printer cover 3 rotates from the open position to the closed position, the front end of the printer cover 3 rotates close to the front end of the front panel 2 and of the housing 8.

When the printer cover 3 is at the open position, the thermal head 12 is away from the platen roller 10.

The printer cover 3 has a front face. The front face is directed upward (UP) when the printer cover 3 is at the closed position. The front face is directed rearward (RR) when the printer cover 3 is at the open position.

The printer cover 3 has a rear face. The rear face is directed downward (LO) when the printer cover 3 is at the closed position. The rear face is directed forward (FR) when the printer cover 3 is at the open position.

In the housing 8, the front panel 2, the container 6, the first assisting roller 13, the platen roller 10, the separator 15, and the feeding guide 24 are disposed.

The container 6 is located closer to the rear end of the housing 8.

The container 6 contains a roll of paper R.

As shown in FIG. 3, when the printer cover 3 is at the open position, the container 6 is accessible from the outside of the printer 1. Then a user can set the roll of paper R into the container 6.

The pair of the paper guide 7*a* and 7*b* may move in a direction in which the paper guide 7*a* and 7*b* approach each other, and in a direction in which the paper guide 7*a* and 7*b* go away from each other. When the user moves the paper guide 7*a* and 7*b*, the paper guide 7*a* and 7*b* contact one end of the roll of paper R contained in the container 6 in an axial direction (LH-RH direction) of the roll of paper R. Thus, the roll of paper R is held at a center portion of the container 6 in the axial direction (LH-RH direction).

The platen roller 10 is located forward (FR) of the first assisting roller 13. The platen roller 10 is rotatablay supported at the housing 8. The axial direction (LH-RH direction) is the same as the direction of rotary axis of the platen roller 10.

The platen roller 10 is connected to a stepping motor (not illustrated). The platen roller 10 rotates under the control of the stepping motor so as to feed the print medium P.

The first assisting roller 13 is located forward (FR) of the container 6. The first assisting roller 13 is rotatably supported at the housing 8. The axial direction (LH-RH direction) is the same as the direction of rotary axis of the first assisting roller 13.

The separator 15 is located forward (FR) of the platen roller 10.

The separator 15 is a member having at least one plane (e.g., a separation plate) or a member having at least one curved surface (e.g., a separation pin).

When the platen roller 10 feeds a print medium P forward (FR), the separator 15 folds back the liner PM of the print medium downward (LO) and rearward (RR) so as to separate the printed label PL from the liner PM.

As shown in FIG. 2, a label ejection port 2*a* is defined between the printer cover 3 at the closed position and the housing 8 (i.e., an upper (UP) part of the front panel 2).

At a lower (LO) part of the front panel 2, a liner ejection port 2*b* is defined.

The label ejection port 2*a* is located forward (FR) of the separator 15.

The label ejection port 2*a* is to eject a label PL separated from the liner PM.

The liner ejection port 2*b* is located below (LO) the label ejection port 2*a*.

The liner ejection port 2*b* is to eject the liner PM after a label PL is separated from the liner PM.

As shown in FIG. 2, when the touch panel display 3 is at the closed position, the touch panel display 4 is located at the top face of the printer cover 3.

The touch panel display 4 displays predetermined information. The predetermined information contains information on the printer 1 and images of operation keys. When a user touches an image of operation key, the processor of the printer 1 receives an instruction corresponding to the touched operation key.

The touch panel display 4 is a liquid crystal display having a touch sensor, for example.

As shown in FIGS. 3 to 5, the printer cover 3 includes the thermal head 12, the second assisting roller 14, a head bracket 20, the head cover 21, a connector unit 22 (one example of a connecting part) and a pair of gears 23. When the printer cover 3 is at the closed position, the thermal head 12, the second assisting roller 14, the head bracket 20, the head cover 21, the connector unit 22, and the pair of gears 23 are located on the lower face of the printer cover 3.

As shown in FIGS. 3 and 4, the head cover 21 is pivotally supported at the printer cover 3. The head cover 21 can move (i.e., can rotate) relative to the printer cover 3 between a closed position (one example of a first position) of FIG. 3 and an open position (one example of a second position) of FIG. 4 about the rotary axis RS2. The rotary axis RS2 is parallel to the rotary axis RS1.

The head cover 21 at the closed position closes a part of the thermal head 12. In this case, a part of the thermal head 12 and the connector unit 22 (FIG. 4) are covered by the head cover 21, and therefore they cannot be seen from the outside of the printer 1.

The head cover 21 at the open position opens the connector unit 22. Specifically a space is defined between the head cover 21 at the open position and the printer cover 3. The connector unit 22 is exposed through this space. The connector unit 22 has a connector 22*a* (described later) as a connecting terminal, and the connector 22*a* is directed upward (UP). In this case, the thermal head 12 and the connector unit 22 can be seen from the outside of the printer 1.

The second assisting roller 14 is rotatably supported at the printer cover 3. The second assisting roller 14 is located at a center of the head cover 21 in axial direction (LH-RH direction). The axial direction (LH-RH direction) is the same as the direction of rotary axis of the second assisting roller 14. That is, when the printer cover 3 is at the closed position, the head cover 21 extends at both sides of the second assisting roller 14 in the direction (LH-RH direction) of the rotary axis thereof.

The second assisting roller 14 assists the feeding of the print medium P while rotating following the rotation of the first assisting roller 13.

As shown in FIG. 5, the head bracket 20 includes a pair of convexes 20*a*, a pair of protrusions 20*b* and a head bracket body 20*d*.

The pair of convexes 20*a* protrudes forward (FR) from the head bracket body 20*d*.

The head cover 21 includes a pair of engaging parts 21*a*, a pair of gears 21*b*, and a guide surface 21*c*.

The pair of engaging parts 21*a* is located at lateral ends of the head cover 21.

The pair of engaging parts 21*a* engages with the pair of protrusions 20*b* so as to lock the head cover 21 at the closed position (FIG. 3).

When a user rotates the head cover 21, the engagement between the pair of engaging parts 21*a* and the pair of protrusions 20*b* is canceled.

Figure 6A:
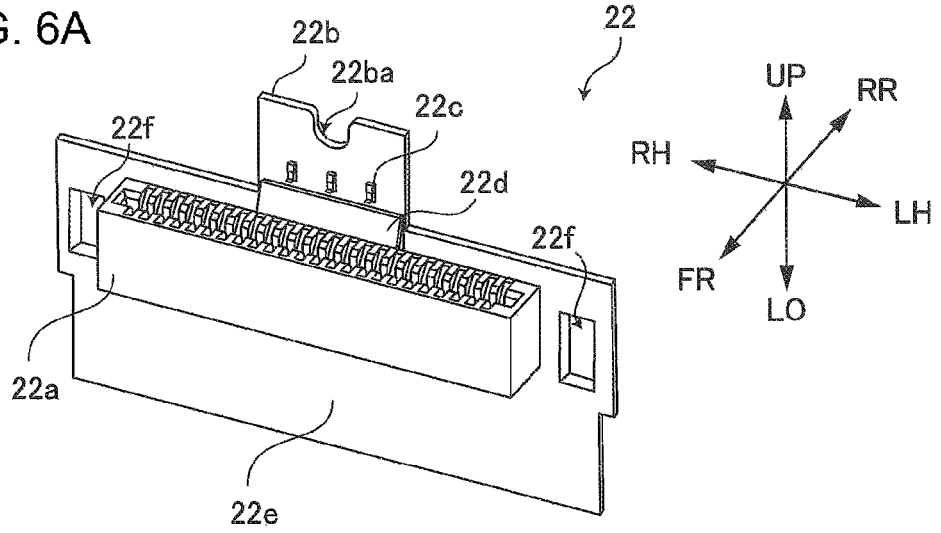
FIG. 6 shows a major part of a connector unit of FIG. 5.
Figure 6B:
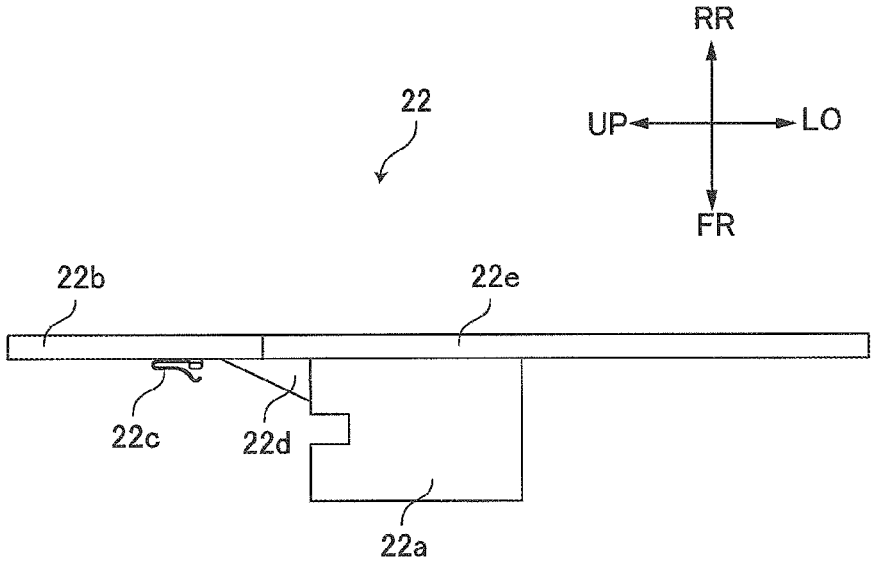

As shown in FIGS. 6A and 6B, the connector unit 22 has a front face. On the front face, the connector 22*a* (one example of a second connector), an abutting part 22*b*, a plurality of metal members 22*c*, a guide 22*d*, a connector board 22*e*, and a pair of engagement holes 22*f* are disposed.

The connector 22*a* is disposed on the front face of the connector board 22*e*.

The abutting part 22*b* protrudes upward (UP) from the upper end of the connector board 22*e*. The abutting part 22*b* has a notch 22*ba*. The notch 22*ba* is at a center of the connector unit 22 in the width direction (LH-RH direction).

The plurality of metal members 22*c* is disposed on the front face of the abutting part 22*b*.

Each of the metal members 22*c* is connected to the earth cable (not illustrated).

Each of the metal members 22*c* is a metal spring, for example.

The guide 22*d* is located above (UP) the connector 22*a*. The guide 22*d* is at a center of the connector unit 22 in the width direction (LH-RH direction).

The front face of the guide 22*d* inclines so that the lower end is located forward (FR) of the upper end (i.e., coming closer to the connector 22*a* from the above (UP) to the below (LO) in the front-rear direction (FR-RR direction)).

As shown in FIG. 5, the pair of gears 23 engages with the pair of engagement holes 22*f* and the pair of gears 21*b*. Such engagement converts the rotary motion of the head cover 21 into the motion of the connector unit 22 in the up-down direction (UP-LO direction) via the pair of gears 23.

That is, a gear mechanism is made up of the pair of gears 21*b* and the pair of gears 23, and this gear mechanism is a moving mechanism to join with the connector unit 22 and with the head cover 21. As the head cover 21 is moved, this moving mechanism moves the connector unit 22 (e.g., slides it in the up-down direction (UP-LO direction)) for connection and disconnection of the thermal head 12 and the connector unit 22.

The thermal head 12 can be connected to and disconnected from the connector unit 22.

Figure 7A:
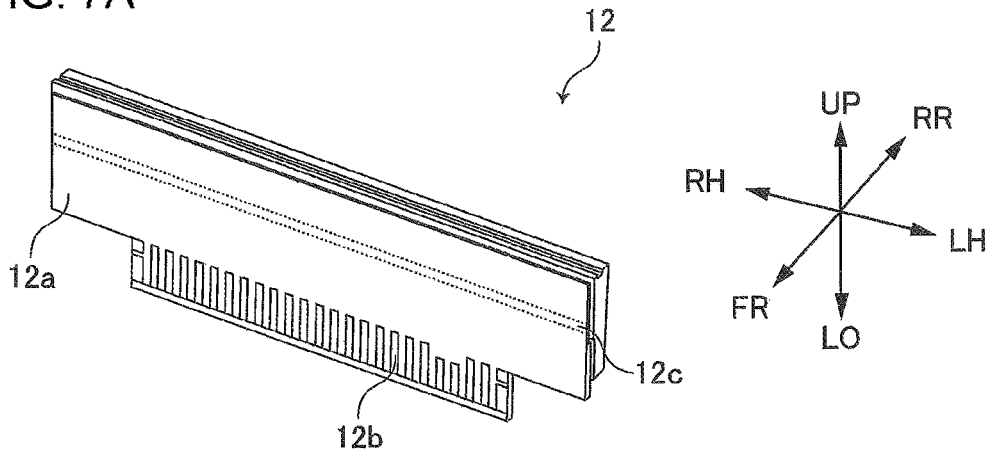
FIG. 7 is a perspective view of a major part of a thermal head of FIG. 5.

As shown in FIG. 7A, the thermal head 12 has a front face. On the front face, a thermal head body 12*a*, a connector 12*b* (one example of a first connector), and a plurality of heater elements 12*c* are disposed.

Figure 7B:
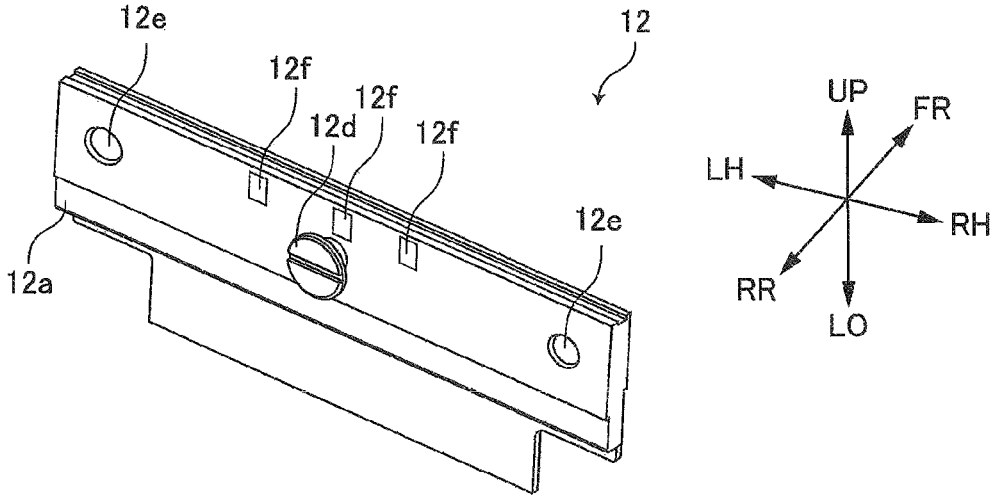

As shown in FIG. 7B, the thermal head 12 has a rear face. On the rear face, a connector unit limiter 12*d* (one example of a connection position limiter), a pair of concaves 12*e* and a plurality of earth parts 12*f* are disposed.

The connector 12*b* protrudes downward (LO) from the thermal head body 12*a*. The connector 12*b* is at a center of the thermal head 12 in the width direction (LH-RH direction).

The plurality of heater elements 12*c* is located above (UP) the connector 12*b*. The plurality of heater elements 12*c* is aligned along the width direction (LH-RH direction) of the thermal head 12. This aligning direction of the plurality of heater elements 12*c* is called a "print line direction".

The pair of concaves 12*e* is located on opposite sides of the connector unit limiter 12*d* in the width direction (LH-RH direction).

As shown in FIG. 7, each of the earth parts 12*f* is located above (UP) the connector unit limiter 12*d* in the up-down direction (UP-LO direction).

The connector unit 22 can be connected to and disconnected from the thermal head 12.

Connecting of the connector unit 22 to the thermal head 12 establishes a connection of the thermal head 12 to a control circuit (not illustrated).

The feeding guide 24 is positioned in a front side FR of the container 6 and in a rear side RR of the platen roller 10.

The feeding guide 24 includes a guide surface 24*a*.

(3) CONNECTION AND DISCONNECTION OF THERMAL HEAD AND CONNECTOR UNIT

Figure 8:
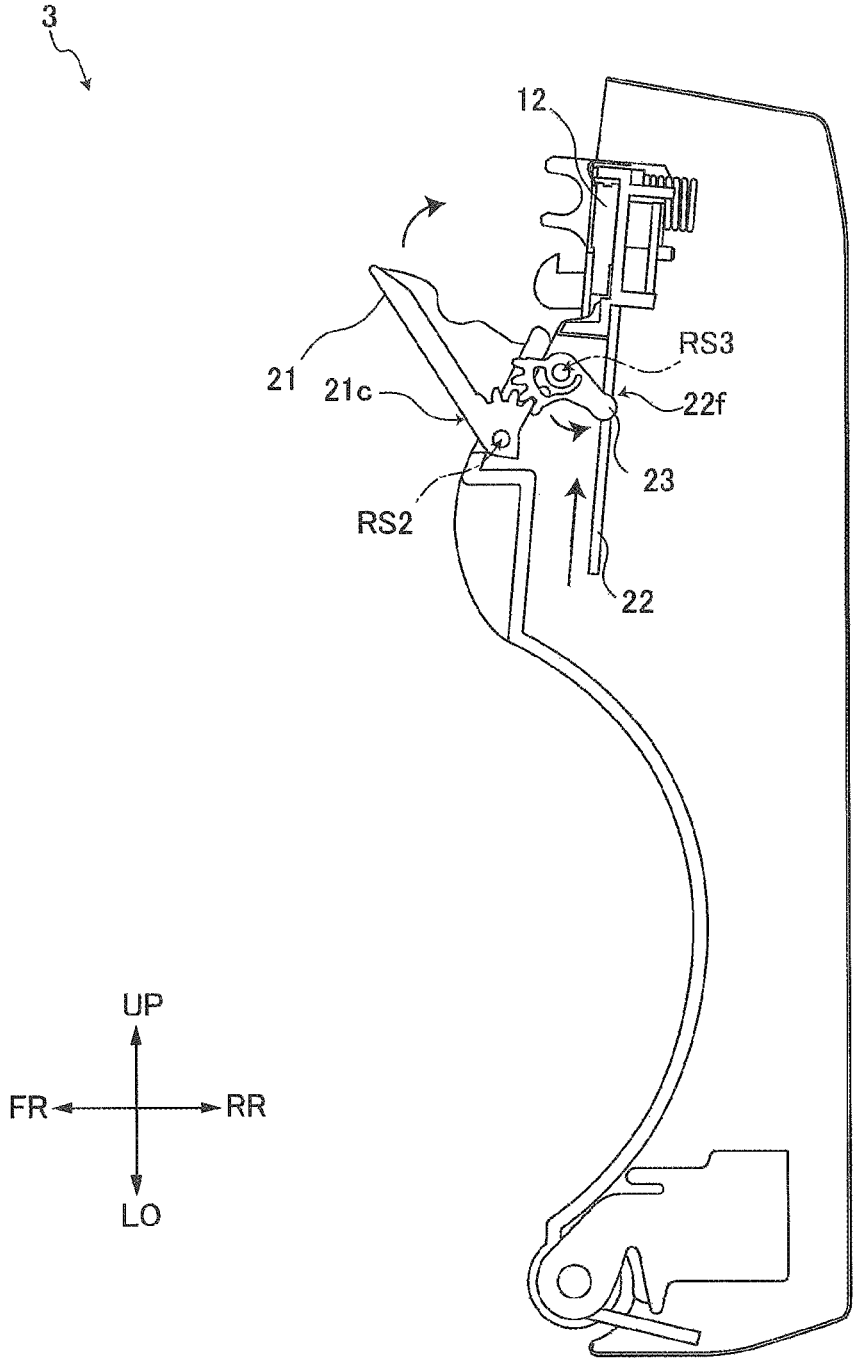
FIGS. 8 to 10 are explanation illustrations of a method of connecting and disconnecting a thermal head and a connect unit of the present embodiment.
Figure 9:
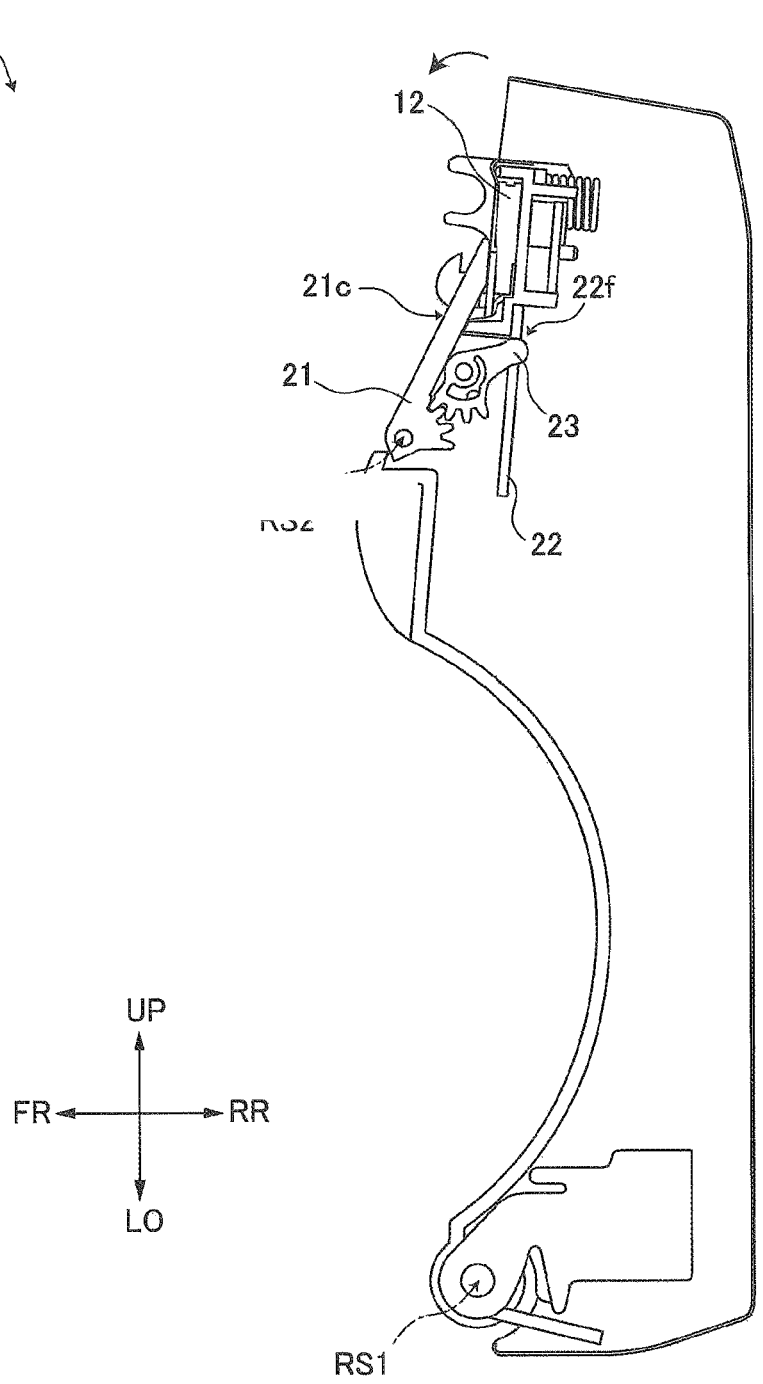
Figure 10:
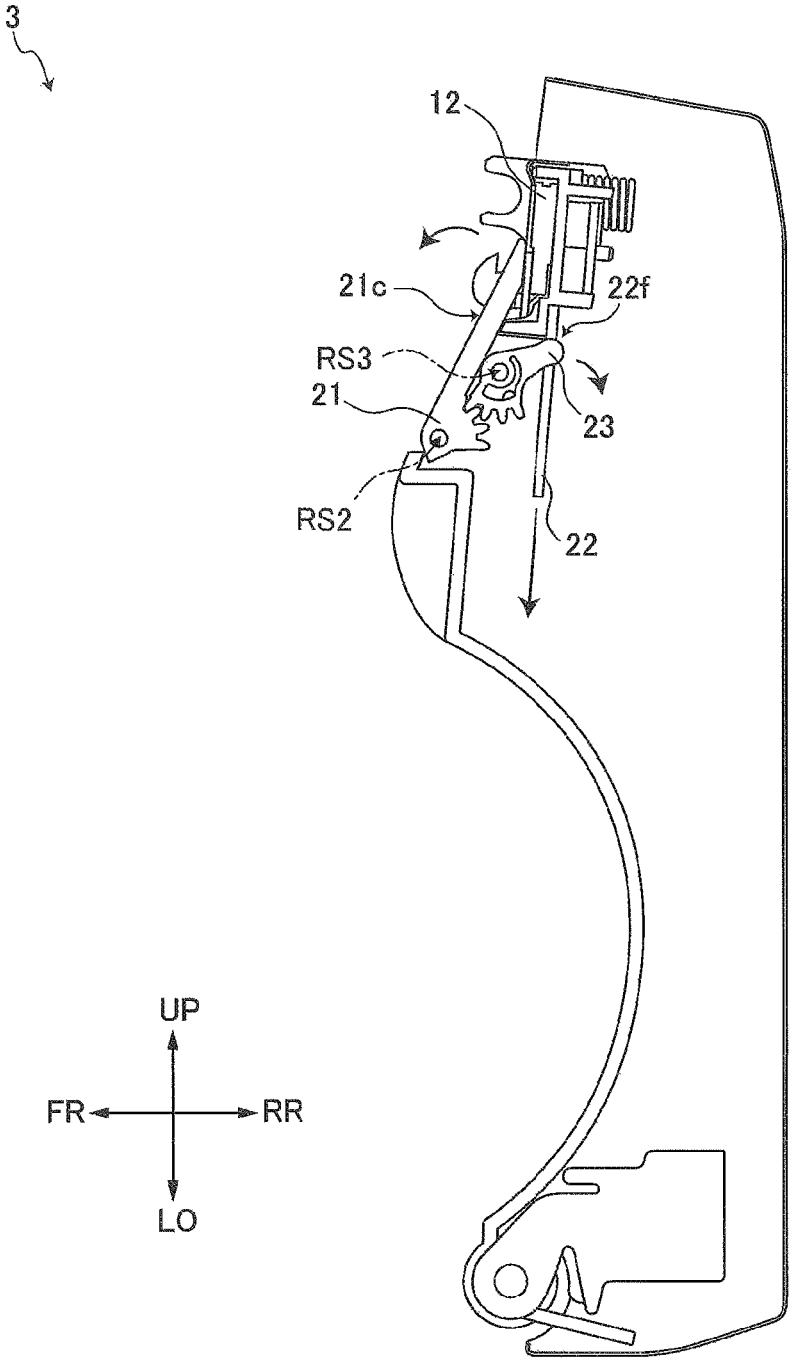

The following describes a connection and a disconnection of the thermal head and connector unit. FIGS. 8 to 10 are explanation illustrations of a method of connecting and disconnecting a thermal head and a connect unit of the present embodiment.

FIGS. 8 to 10 illustrate a cross-section of a major part of the printer cover 3 positioned at the open position (FIG. 3).

As shown in FIG. 8, when the printer cover 3 is at the open position and the head cover 21 is at the open position, the thermal head 12 is opened. At this time, the thermal head 12 may be visible from the front side (FR) of the printer cover 3.

When the user rotates the head cover 21 clockwise (FIG. 8) about the rotary axis RS2, the gear 23 rotates counterclockwise (FIG. 8) about the rotary axis RS3. The rotating gear 23 pushes the engagement hole 22*f* upward (UP) to move the connector unit 22 upward (UP), that is, in a direction in which the connector unit 22 approaches the thermal head 12 held by the head bracket 20.

As a result, as shown in FIG. 9, the head cover 21 moves to the open position. Thereby, the thermal head 12 and the connector unit 22 are connected.

Then, when the user rotates the printer cover 2 counterclockwise (FIG. 9) about the rotary axis RS1, the printer cover 3 moves to the closed position (FIG. 2).

When the head cover 21 is position at the open position (FIG. 9), the user rotates the head cover 21 counterclockwise (FIG. 10) about the rotary axis RS2, the gear 23 rotates clockwise (FIG. 10) about the rotary axis RS3. The rotating gear 23 pushes the engagement holes 22*f* downward (LO) to move the connector unit 22 downward (LO), that is, in a direction in which the connector unit 22 goes away from the thermal head 12 held by the head bracket 20.

As a result, as shown in FIG. 8, the head covers 21 moves to the open position. Thereby, the thermal head 12 is disconnected from the connector unit 22.

(4) FEED PATH

Figure 11:
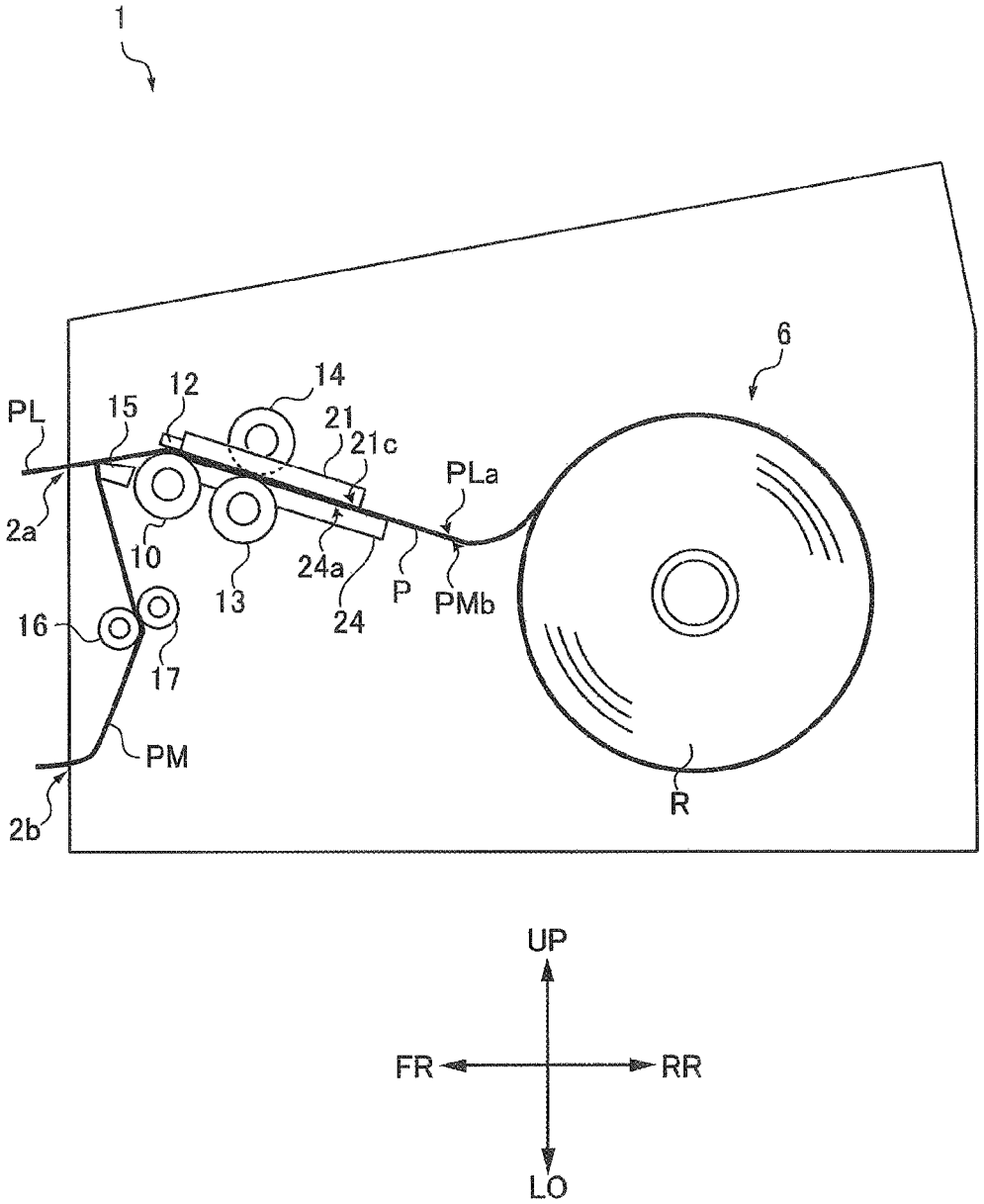
FIG. 11 schematically describes a feed path of the present embodiment.

The following describes a feed path of the present embodiment. FIG. 11 schematically describes a feed path of the present embodiment.

As shown in FIG. 11, when the printer cover 3 is at the closed position and the head cover 21 is at the open position, the guide surface 21*c* opposes the platen roller 10, the first assisting roller 13, the second assisting roller 14, and the guide surface 24*a*.

The feed path of the print medium P is a path between the container 6 and the separator 15. The feed path of the print medium P extends through the guide surface 21*c*, the guide surface 24*a*, the first assisting roller 13, the second assisting roller 14, the thermal head 12 and the platen roller 10.

The feed path of the labels PL is a path between the separator 15 and the label ejection port 2*a*.

The feed path of the liner PM is a path between the separator 15 and the liner ejection port 2*b*. The feed path of the liner PM extends through a first nip roller 16 and a second nip roller 17.

The container 6 contains a roll of paper R.

The first assisting roller 13 and the second assisting roller 14 are located downstream of the container 6 in the feeding direction. The first assisting roller 13 is located under (LO) the feed path. The second assisting roller 14 is located below (UP) the feed path. That is, when the printer cover 3 is at the closed position (FIG. 2), the first assisting roller 13 and the second assisting roller 14 are opposed.

The first assisting roller 13 is connected to a stepping motor. The first assisting roller 13 rotates under the control of the stepping motor.

The second assisting roller 14 rotates following the rotation of the first assisting roller 13.

The first assisting roller 13 and the second assisting roller 14 rotate while keeping the print medium P therebetween so as to assist the feeding of the print medium P.

The platen roller 10 and the thermal head 12 are located downstream of the first assisting roller 13 and the second assisting roller 14 in the feeding direction. The platen roller 10 is located below (LO) the feed path.

The thermal head 12 is located above (UP) the feed path. That is, when the printer cover 3 is at the closed position (FIG. 2), the platen roller 10 and the thermal head 12 are opposed.

The separator 15 is located downstream of the platen roller 10 and the thermal head 12 in the feeding direction.

The upper face and the front face of the separator 15 define a sharp angle.

The first nip roller 16 and the second nip roller 17 are located downstream of the separator 15 in the feeding direction. The first nip roller 16 and the second nip roller 17 are opposed.

The first nip roller 16 rotates following the rotation of the second nip roller 17.

The second nip roller 17 is connected to a stepping motor. The second nip roller 17 rotates under the control of the stepping motor.

The first nip roller 16 and the second nip roller 17 rotate while keeping the liner PM therebetween so as to feed the liner PM from the separator 15 to the liner ejection port 2*b*. The axial direction (LH-RH direction) is the same as the rotary axis of the first nip roller 16 and the second nip roller 17.

As the platen roller 10 rotates forward (counterclockwise in FIG. 8), a belt-like print medium P (the combination of labels PL and liners PM) is extracted from the container 6 to the downstream of the container 6 in the feeding direction. The lower face of the extracted print medium P is the non temporary-adhesive face PMb of the liner PM. The upper face of the extracted print medium P is the print surface PLa.

As the platen roller 10 rotates forward, the first assisting roller 13 rotates counterclockwise in FIG. 8 while having a contact with the non temporary-adhesive face PMb. At the same time, the second assisting roller 14 rotates clockwise in FIG. 8 while having a contact with the print surface PLa.

The print medium P extracted from the container 6 passes through between the platen roller 10 and the thermal head 12 while the print surface PLa (that is, the top surface) thereof contacts the guide surface 21*c* and the second assisting roller 14, and the non temporary-adhesive face PMb (that is, the bottom surface) thereof contacts the guide surface 24*a* and the first assisting roller 13.

In other words, the head cover 21 and the feeding guide 24 are configured to guide the top surface and the bottom surface of the print medium P fed by the platen roller 10 along the feed path, respectively.

The control circuit receives print data corresponding to information to be printed on the print surface PLa (hereinafter called "print information") in response to a user's instruction. The control circuit controls the heater elements to generate heat in accordance with the print data.

When the print medium P passes through between the thermal head 12 and the platen roller 10, the heater elements generating heat are pressed against the print surface PLa. Due to the heat of the heater elements, the thermosensitive layer at the print surface PLa develops a color. As a result, print information is printed on the print surface PLa.

The label PL is fed from the front end of the separator 15 to the label ejection port 2*a*.

The liner PM along the front face of the separator 15 is folded back downward (LO) and rearward (RR), and then is fed toward the liner ejection port 2*b*.

In other words, the separator 15 folds back the liner PM at a sharp angle relative to the label PL. As a result, the separator 15 separates the label PL from the liner PM.

The label PL separated from the liner PM is ejected from the label ejection port 2*a*.

The liner PM after the label PL is separated (i.e., the liner PM passing through the front end of the separator 15) passes through between the first nip roller 16 and the second nip roller 17, and then is ejected from the liner ejection port 2*b*.

(5) SUMMARY OF EMBODIMENT

The following describes summary of the present embodiment.

As shown in FIGS. 8 to 10, when the user moves the head cover 21, connecting or disconnecting of the connector 12*b* as the connecting terminal of the thermal head 12 and the connector 22*a* as the connecting terminal of the printer body occurs. That is, the head cover 21 acts as an operation member to connect and disconnect the thermal head and the connector unit 22. Furthermore, as shown in FIG. 11, the head cover 21 is configured to guide the print medium P fed by the platen roller 10.

Thereby, the feeding print medium P may be smoothly fed between the container 6 and the platen roller 10.

The head cover 21 has a function of connecting and disconnecting the thermal head 12 and the connector unit 22, and a function of closing the thermal head 12, a function of guiding the print medium P. Therefore, a dedicated member such as a guide roller for guiding the printer medium P does not need. Thereby, the production cost and the maintenance cost of the printer 1 may be reduced.

As shown in FIG. 11, the head cover 21 guides the print surface PLa. That is, the head cover 21 contacts the print surface PLa.

The platen roller 10 contacts the non temporary-adhesive face PMb (that is, the opposite surface to the print surface PLa of surfaces of the print medium P).

Thereby, the feeding print medium P may be stable.

As shown in FIG. 11, the second assisting roller 14 and the head cover 21 contact the print surface PLa.

Thereby, the feeding print medium P may be more stable.

As shown in FIGS. 8 to 10, the user can connect or disconnect the thermal head 12 and the connector unit 22 without touching the thermal head 12 and the connector unit 22. This facilitates the connecting and disconnecting of the thermal head 12 and the connector unit 22.

When a user touches the thermal head 12, dirt may adhere to the thermal head 12. Such dirt may cause malfunction of the thermal head 12. According to the present embodiment, after attaching the thermal head 12 to the head bracket 20 for holding, a user need not touch the thermal head 12. This can suppress adherence of dirt to the thermal head 12.

As shown in FIGS. 8 to 10, when the printer cover 3 is at the open position, the head cover 21 pivotally supported at the printer cover 3 may rotate between the closed position in which a part of the thermal head 12 is closed and the open position in which the thermal head 12 is opened.

As shown in FIG. 11, when the printer cover 3 is at closed position, the feeding guide 24 opposes the head cover 21 which is at the closed position. The head cover 21 guides the print surface PLa. The feeding guide 24 guides the non temporary-adhesive face PMb.

That is, the head cover 21 contacts the print medium P downward (LO), and the feeding guide 24 contacts the print medium P upward (UP).

Thereby, feeding the print medium P may be more stable.

(6) MODIFIED EXAMPLES

The following describes modified examples of the present embodiment.

(6-1) Modified Example 1

The following describes Modified Example 1. Modified Example 1 describes a preferable example in the case that the used print medium P is a label PL without a liner PM.

In the case that the used print medium P is a label PL without a liner PM, the adhesive applied on the sticking surface PLb may be adhered on the print surface PLa in the container 6.

A first example of the modified Example 1, preferably, non-adhesive process such as Teflon (registered trademark) coating is applied on the guide surface 21*c*.

Thereby, it is prevented that the adhesive adhered on the print surface PLa adheres on the guide surface 21*c*.

A second example of the modified Example 1, preferably, the guide surface 21*c* includes a rib.

In this case, the rib reduces a contact area of the print surface PLa and the guide surface 21*c*. Thereby, the adhesive adhered on the print surface PLa may hardly affect adversely to feeding.

(6-2) Modified Example 2

Figure 12:
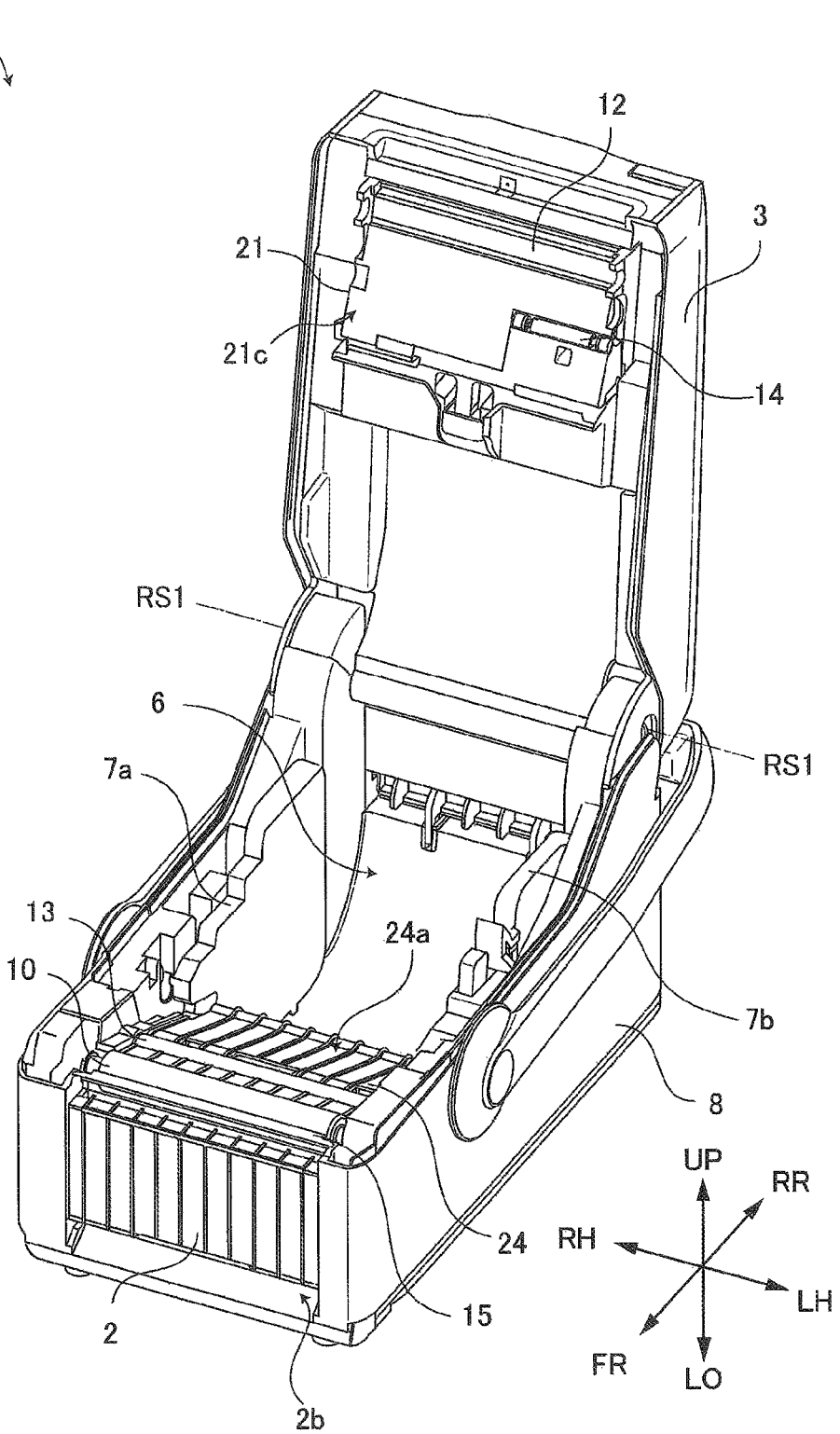
FIG. 12 is a perspective view of the printer of the Modified Example 2 when the printer cover is at an open position and the head cover is at a closed position.

The following describes Modified Example 2. Modified Example 2 describes a printer that includes a feed assisting roller. FIG. 12 is a perspective view of the printer of the Modified Example 2 when the printer cover is at an open position and the head cover is at a closed position.

As shown in FIG. 12, the second assisting roller 14 protrudes from the guide surface 21*c* to the front side (FR) at the LH side end of both ends thereof in the axial direction (LH-RH direction).

In other words, the guide surface 21*c* extends on one side (RH side) in the axial direction (LH-RH direction).

The paper guide 7*a* on RH side may move in the axial direction (LH-RH direction). The paper guide 7*b* on LH side is fixed on the housing 8. That is, for the pair of the paper guides 7*a* and 7*b*, only one paper guide may move. This point is different from the paper guides 7*a* and 7*b* shown in FIG. 3. Thereby, the roll R of paper is held on one end (LH side end) of the container 6 in the axial direction (LH-RH direction) regardless of the size of the roll R of paper.

As described above, the second assisting roller 14 is disposed on one end (LH side end) of the guide surface 21*c* in the axial direction. This configuration may make the present embodiment apply the case that the roll R of paper is held on one end (LH side end) in the container 6.

(6-3) Modified Example 3

The following describes Modified Example 3. Modified Example 3 describes a preferable example of the size of the head cover 21.

A longer distance between the rotary axis RS2 of the head cover 21 of FIG. 5 and the upper end of the head cover 21 of the FIG. 3 is preferred. Such a longer distance means a smaller force required to rotate the head cover 21.

That is, such a longer distance can reduce the burden on user's operation to connect or disconnect the thermal head 12 and the connector unit 22.

(6-4) Modified Example 4

The following describes Modified Example 4. Modified Example 4 describes a preferable example of a ratio of the number of gear teeth of the pair of gears 21*b* to the pair of gears 23 (hereinafter called a "gear ratio").

A larger gear ratio of the pair of gears 21*b* to the pair of gears 23 is preferred.

Such a larger gear ratio means a smaller amount of rotation of the head cover 21 required for connection or disconnection of the thermal head 12 and the connector unit 22. Such a larger gear ratio means a smaller force required to rotate the head cover 21.

That is, a larger gear ratio can reduce the burden on user's operation to connect or disconnect the thermal head 12 and the connector unit 22.

(6-5) Modified Example 5

The following describes Modified Example 5. In Modified Example 5, the connector unit 22 moves in response to the operation performed to an operation member different from the head cover 21.

In one example, the printer cover 3 (FIG. 3) has a lever (one example of the operation member).

The lever has a pair of gears. The pair of gears of the lever engages with the pair of gears 23 (FIG. 5). Such engagement converts the rotary motion of the lever into the motion of the connector unit 22 in the up-down direction (UP-LO direction) via the pair of gears 23.

That is, a gear mechanism is made up of the pair of gears of the lever and the pair of gears 23, and this gear mechanism is a moving mechanism to join with the connector unit 22. This moving mechanism moves the connector unit 22 in response to the rotating operation of the lever.

In Modified Example 5, the head cover 21 (FIG. 3) can be omitted.

(6-6) Modified Example 6

The following describes Modified Example 6. In Modified Example 6, a user moves the thermal head 12 instead of the connector unit 22 to connect or disconnect the thermal head 12 and the connector unit 22.

In one example, a head bracket 20 of FIG. 5 has a pair of engagement holes. The head bracket 20 holds the thermal head 12.

The pair of gears 23 engages with the pair of engagement holes of the head bracket 20 and not with the pair of engagement holes 22*f*. That is, the head cover 21 joins with the thermal head 12 held by the head bracket 20 via the pair of gears 23.

When a user rotates the head cover 21 clockwise around the rotary axis RS2 of FIG. 11, the head bracket 20 moves downward (LO) (i.e., in the direction toward the connector unit 22) with the rotation of the gears 23 while holding the thermal head 12.

As stated above, in Modified Example 6, the moving mechanism moves the head bracket 20 with the motion of the head cover 21. Connection or disconnection of the thermal head 12 and the connector unit 22 occurs with the motion of the head bracket.

(6-7) Modified Example 7

The following describes Modified Example 7. Modified Example 7 describes an example, in which a connecting board moves with the rotation of the head cover, the connecting board being connectable to the thermal head.

Figure 13:
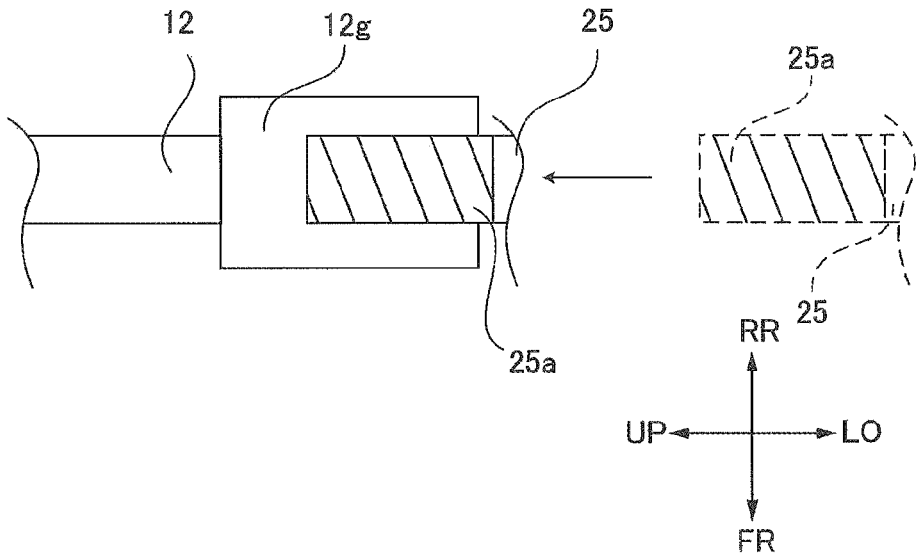
FIG. 13 schematically shows Modified Example 7 of the present embodiment.

FIG. 13 schematically shows Modified Example 7 of the present embodiment.

As shown in FIG. 13, a connector 12*g* (one example of the first connector) is attached to the thermal head 12 of Modified Example 7.

The connecting board 25 (one example of the connecting part) can connect to the connector 12*g*. The connecting board 25 includes a connector 25*a* (one example of the second connector). The connector 25*a* protrudes upward (UP) from the connecting board 25.

The connecting board 25 converts the rotary motion of the head cover 21 into the motion of the connecting board 25 in the up-down direction (UP-LO direction) due to a configuration similar to that of FIG. 5, for example.

The rotation of the head cover 21 moves the connecting board 25 in the up-down direction (UP-LO direction). This results in connection or disconnection of the connecting board 25 and the connector 12*g*.

That is, the head cover 21 of Modified Example 7 moves the connecting board 25.

As described above, when the user moves the head cover 21 of Modified Example 7, connection or disconnection of the connector 12*g* as the connecting terminal of the thermal head 12 and the connector 25*a* as the connecting terminal of the printer body occurs. This enables connection or disconnection of the thermal head 12 and the connecting board 25 without touching the thermal head 12 and the connecting board 25. This facilitates for the user connect or disconnect of the thermal head 12 and the connecting board 25.

(7) OTHER MODIFIED EXAMPLES

The following describes other modified examples.

The above embodiments exemplify the print medium P having the liner PM and the labels PL, and the print medium P is not limited to this. The print medium P may be a label PL without a liner PM, for example.

The above embodiments exemplify printing with the thermal head 12, and means for printing is not limited to the thermal head 12.

The present embodiment is applicable to printing using an ink ribbon as well.

That is detailed descriptions on the embodiments of the present invention, and the scope of the present invention is not limited to these embodiments. The above embodiments can be modified or changed variously without departing from the scope of the present invention. The above embodiments and modified examples can be combined.

REFERENCE SIGNS LIST

1: printer
2: front panel
2*a*: label ejection port
2*b*: liner ejection port
3: printer cover
4: touch panel display
6: container
7*a*: paper guide
7*b*: paper guide
8: housing
10: platen roller
12: thermal head
12*a*: thermal head body
12*b*, 12*g*: connector
12*c*: heater element
12*d*: connector unit limiter
12*e*: concave
12*f*: earth part
13: first assisting roller
14: second assisting roller
15: separator
16: first nip roller
17: second nip roller
20: head bracket
20*a*: convex
20*b*: protrusion
20*d*: head bracket body
21: head cover
21*a*: engaging part
21*b*: gear
21*c*: guide surface
22: connector unit
22*a*: connector
22*b*: abutting part
22*ba*: notch
22*c*: metal member

22*d*: guide
22*e*: connector board
22*f*: engagement hole
23: gear
24: feeding guide
25: connecting board
25*a*: connector

What is claimed is:

1. A printer, comprising:

a housing;

a printer cover configured to rotate between a closed position at which the printer cover closes an interior of the housing and an open position at which the printer cover opens the interior of the housing;

a platen roller configured to feed print medium;

a thermal head opposed to the platen roller when the printer cover is located at the closed position;

an operation member configured to electrically connect and disconnect the thermal head in response to movement of the operation member, the operation member configured to guide the print medium fed by the platen roller when the printer cover is located at the closed position.

2. The printer according to claim 1, wherein the operation member is a head cover of the thermal head.

3. The printer according to claim 2, wherein the head cover is configured to rotate between a closed position at which the head cover encloses at least part of the thermal head and an open position at which the head cover opens the thermal head.

4. The printer according to claim 2, wherein the operation member is configured to guide a print surface of the print medium fed by the platen roller, and the platen roller comes in contact with the opposite surface to the print surface.

5. The printer according to claim 2, wherein a non-adhesive process has been applied to the operation member.

6. The printer according to claim 2, further comprising an assisting roller configured to assist feeding of the print medium, wherein the operation member extends on one side or both sides of the assisting roller in a rotation axis direction of the assisting roller when the printer cover is located at the closed position.

7. The printer according to claim 2, wherein the operation member comprises a rib.

8. The printer according to claim 2, further comprising a connector capable of being electrically connected to and disconnected from the thermal head, wherein the operation member moves between a first position and a second position different from the first position to electrically connect and disconnect the thermal head and the connector.

9. The printer according to claim 2, wherein the printer cover pivotally supports the operation member.

10. The printer according to claim 2, further comprising a feeding guide opposite to the operation member when the printer cover is located at the closed position.

11. The printer according to claim 1, wherein the operation member is configured to guide a print surface of the print medium fed by the platen roller, and the platen roller contacts with the opposite surface to the print surface.

12. The printer according to claim 1, wherein a non-adhesive process has been applied to the operation member.

13. The printer according to claim 1, further comprising an assisting roller configured to assist feeding of the print medium, wherein the operation member extends on one side or both sides of the assisting roller in a rotation axis direction of the assisting roller when the printer cover is located at the closed position.

14. The printer according to claim 1, wherein the operation member comprises a rib.

15. The printer according to claim 1, further comprising a connector capable of being electrically connected to and disconnected from the thermal head, wherein the operation member moves between a first position and a second position different from the first position to electrically connect and disconnect the thermal head and the connector.

16. The printer according to claim 1, wherein the printer cover pivotally supports the operation member.

17. The printer according to claim 1, further comprising a feeding guide opposite to the operation member when the printer cover is located at the closed position.

18. The printer according to claim 17, wherein the operation member is configured to guide a print surface of the print medium fed by the platen roller, and the feeding guide is configured to guide the opposite surface to the print surface.

19. A printer, comprising:

a housing;

a printer cover configured to rotate between a closed position at which the printer cover closes an interior of the housing and an open position at which the printer cover opens the interior of the housing;

a platen roller configured to feed print medium;

a thermal head opposed to the platen roller when the printer cover is located at the closed position;

an operation member configured to connect and disconnect the thermal head, the operation member configured to guide the print medium fed by the platen roller when the printer cover is located at the closed position;

a connector capable of being connected to and disconnected from the thermal head, wherein the operation member moves between a first position and a second position different from the first position to connect and disconnect the thermal head and the connector; and a moving mechanism joined with the connector and the operation member, wherein the moving mechanism moves the connector or the thermal head in a response to the moving of the operation member.

20. A printer, comprising:

a housing;

a printer cover configured to rotate between a closed position at which the printer cover closes an interior of the housing and an open position at which the printer cover opens the interior of the housing;

a platen roller configured to feed print medium;

a thermal head opposed to the platen roller when the printer cover is located at the closed position;

an operation member configured to connect and disconnect the thermal head, the operation member configured to guide the print medium fed by the platen roller when the printer cover is located at the closed position;

a connector capable of being connected to and disconnected from the thermal head, wherein the operation member moves between a first position and a second position different from the first position to connect and disconnect the thermal head and the connector; and a moving mechanism joined with the connector and the operation member, wherein the moving mechanism moves the connector or the thermal head in a response to the moving of the operation member.

21. A printer, comprising:

a housing;

a printer cover configured to rotate between a closed position at which the printer cover closes an interior of the housing and an open position at which the printer cover opens the interior of the housing;

a platen roller configured to feed print medium;

a thermal head opposed to the platen roller when the printer cover is located at the closed position; and an operation member configured to electrically connect the thermal head to and disconnect the thermal head from the printer cover, the operation member configured to guide the print medium fed by the platen roller when the printer cover is located at the closed position.

* * * * *